US010458074B1

(12) United States Patent
Dagesse

(10) Patent No.: US 10,458,074 B1
(45) Date of Patent: Oct. 29, 2019

(54) ACCESS MAT COMPRISING SINGLE UNITARY PULTRUDED BODY

(71) Applicant: Paul Dagesse, Beaverlodge (CA)

(72) Inventor: Paul Dagesse, Beaverlodge (CA)

( * ) Notice: Subject to any disclaimer, the term of this patent is extended or adjusted under 35 U.S.C. 154(b) by 0 days.

(21) Appl. No.: 16/026,269

(22) Filed: Jul. 3, 2018

(51) Int. Cl.
*E01C 9/08* (2006.01)
*E01C 5/00* (2006.01)
*E01C 5/20* (2006.01)

(52) U.S. Cl.
CPC ..... *E01C 9/086* (2013.01); *E01C 5/003* (2013.01); *E01C 5/005* (2013.01); *E01C 5/20* (2013.01); *E01C 2201/167* (2013.01)

(58) Field of Classification Search
CPC . E01C 5/003; E01C 5/005; E01C 5/20; E01C 2201/167; E01C 9/086
See application file for complete search history.

(56) References Cited

U.S. PATENT DOCUMENTS 4,488,833 A * 12/1984 Perry ..... E01C 5/005 14/27
4,747,441 A * 5/1988 Apolzer ..... B60J 7/041 160/206
5,050,362 A * 9/1991 Tal ..... E04C 2/543 404/41
5,088,434 A * 2/1992 Harding ..... B63B 7/082 114/345
5,342,141 A * 8/1994 Close ..... E01C 5/001 404/28
5,502,930 A * 4/1996 Burkette ..... E04B 2/7429 16/225
6,170,212 B1 * 1/2001 Suchyna ..... E01C 5/20 52/177
6,199,340 B1 * 3/2001 Davis ..... C08L 23/10 52/100
7,090,430 B1 * 8/2006 Fletcher ..... E01C 9/086 404/35
8,146,317 B1 * 4/2012 Fletcher ..... E01C 5/005 52/582.1
2006/0165486 A1 * 7/2006 Ungurean ..... E01C 9/083 404/40
2007/0119002 A1 * 5/2007 Baranoff ..... E01C 9/086 14/69.5

(Continued)

*Primary Examiner* — Abigail A Risic
(74) *Attorney, Agent, or Firm* — Ryan W. Dupuis; Ade + Company Inc; Adrian D. Battison

(57) ABSTRACT

An access mat comprises a single unitary body having a generally planar upper wall, a bottom wall and side walls joining side edges of the upper wall and the bottom wall, formed by pultrusion from composite material comprising longitudinally continuous fibers and a set resin so as to define an elongated tubular body enclosing a hollow interior. The unitary body includes integrally formed parallel reinforcing ribs bridging the hollow interior in a thickness direction. The bottom wall has recessed channels therein receiving pultruded elongate connector members each shaped to fit into a respective one of the recessed channels with a bottom surface of the connector member coplanar with the bottom surface and a top surface of the connector member in engagement with a raised surface of the respective recessed channel for connecting of an end of the body to an adjacent end of another body by bridging between the bodies.

3 Claims, 2 Drawing Sheets

(56) References Cited

U.S. PATENT DOCUMENTS

| | | | | |
|---|---|---|---|---|
| 2007/0258765 | A1* | 11/2007 | Coyle | E01C 5/20 404/19 |
| 2008/0083182 | A1* | 4/2008 | Fletcher | E01C 5/005 52/403.1 |
| 2008/0201874 | A1* | 8/2008 | Coyle | E01C 5/20 14/71.1 |
| 2009/0301004 | A1* | 12/2009 | Dagesse | E01C 9/086 52/177 |
| 2016/0177516 | A1* | 6/2016 | Penland, Jr. | E01C 9/086 404/35 |
| 2016/0208444 | A1* | 7/2016 | Penland, Jr. | E01C 5/14 |
| 2016/0298302 | A1* | 10/2016 | Penland, Jr. | E01C 9/086 |
| 2018/0030665 | A1* | 2/2018 | Dagesse | B29C 70/52 |

* cited by examiner

ACCESS MAT COMPRISING SINGLE UNITARY PULTRUDED BODY

FIELD OF THE INVENTION

The present invention relates generally to access mats, and more particularly to access mats comprising pultruded components.

BACKGROUND

Conventionally, access mats are made from wooden timbers arranged in a plurality of layers where the timbers of each layer are arranged parallel to one another and those of adjacent layers are arranged in crisscrossing fashion. The timbers of all layers are fastened together in a thickness direction of the mat.

It is often desirable to form an interconnected series of such mats arranged end-to-end. Typically, these mats are interconnected by protruding integral timbers of one mat of an adjacent pair, formed by offsetting select timbers of one of the mat layers in a longitudinal direction of the timbers, which are received in corresponding receptacles of another one of the adjacent pair of mats formed at recessed ends of the selected offset timbers which are inwardly spaced from a periphery of the mat.

SUMMARY OF THE INVENTION

According to an aspect of the invention there is provided an access mat comprising:

a single unitary body having a generally planar upper wall, a bottom wall and two side walls joining side edges of the upper wall and the bottom wall;

the upper wall forming an upper horizontal surface arranged to receive materials to be supported and the bottom wall arranged to rest on the ground;

the single unitary body including the upper wall, bottom wall and side walls being formed by pultrusion from composite material comprising longitudinally continuous fibers and a set resin so as to define an elongated tubular body of constant cross section enclosing a hollow interior of the single unitary body;

the single unitary body being free of filler material such that the hollow interior thereof is empty of filler material;

the single unitary body including a plurality of parallel reinforcing ribs extending along a length of the single unitary body and bridging the hollow interior in a direction across the thickness of the single unitary body so as to resist compression of the single unitary body in the direction of the thickness of the single unitary body, said ribs being integrally formed with the single unitary body by pultrusion from composite material comprising longitudinally continuous fibers and a set resin;

the bottom wall having a plurality of recessed channels therein where the recessed channels have a depth from the bottom surface greater than the thickness of the bottom wall, the recessed channels being arranged longitudinally of the single unitary body at spaced positions across the width of the single unitary body spaced from the side walls;

and a plurality of elongate connector members each shaped to fit into a respective one of the recessed channels with a bottom surface of the connector member coplanar with the bottom surface and a top surface of the connector member in engagement with a raised surface of the respective recessed channel;

the elongate connector members being arranged for connection of an end of the single unitary body to an adjacent end of another single unitary body by bridging from said single unitary body to the adjacent single unitary body;

the elongate connector members being formed by pultrusion from composite material comprising longitudinally continuous fibers and a set resin so as to define an elongated tubular body of constant cross section enclosing a hollow interior of the respective connector member.

This arrangement of access mat provides a sufficiently strong, one piece access mat. The single unitary body of the access mat is connectable with other like single unitary bodies by bridging elongated pultruded connector members received in channels formed in the bottom of the unitary body.

Typically, each connector member includes a plurality of reinforcing ribs each spaced from the next in the direction of the width of the member.

In one arrangement, the thickness of the respective connector member lies in a range between 1" and 2.25" and the width of the respective member lies in a range between 6" and 10".

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 1:
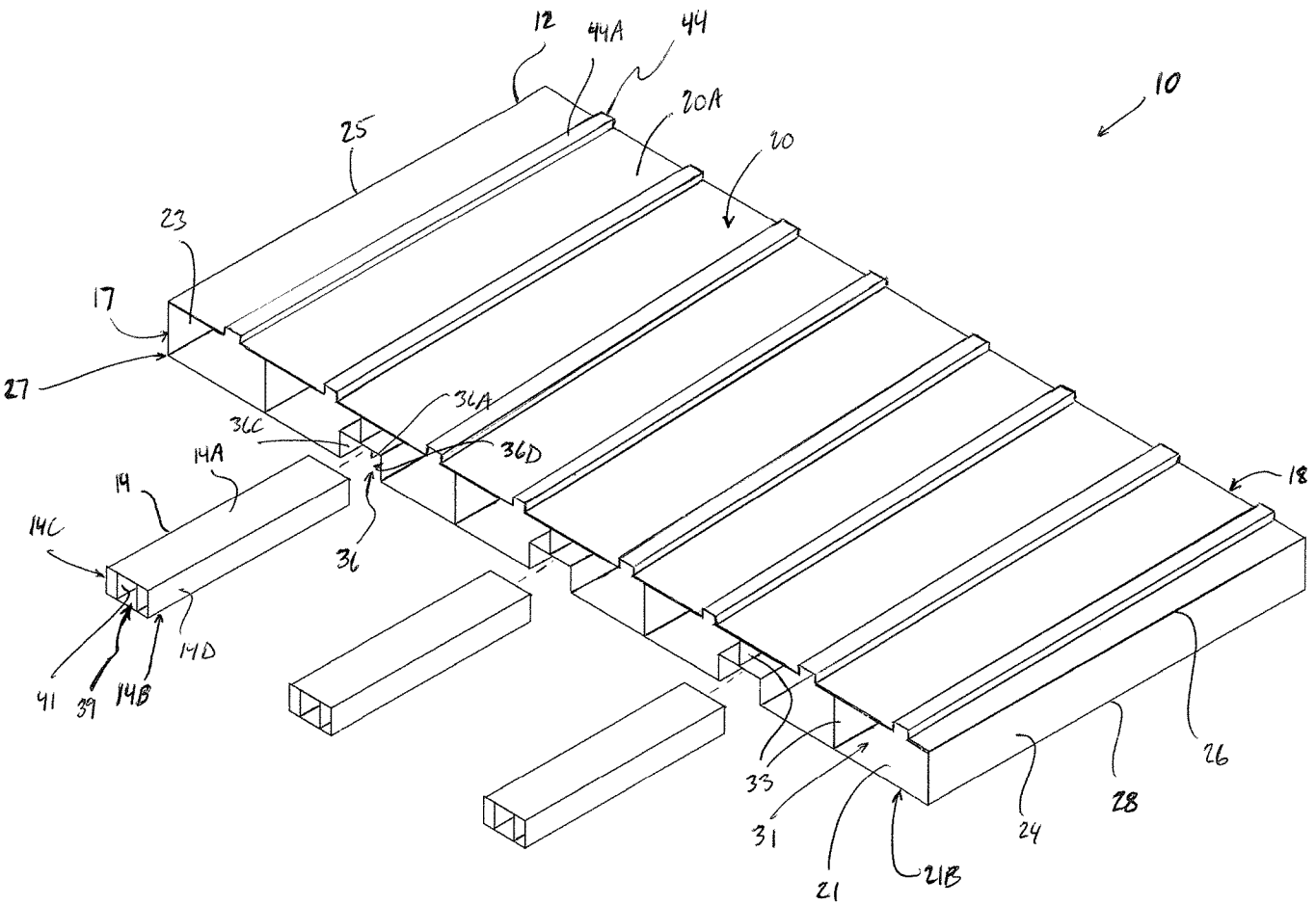
FIG. 1 is an exploded perspective view of an arrangement of access mat according to the present invention, where a mat body and connector members are shown as having a truncated length for clarity of illustration.
Figure 2:
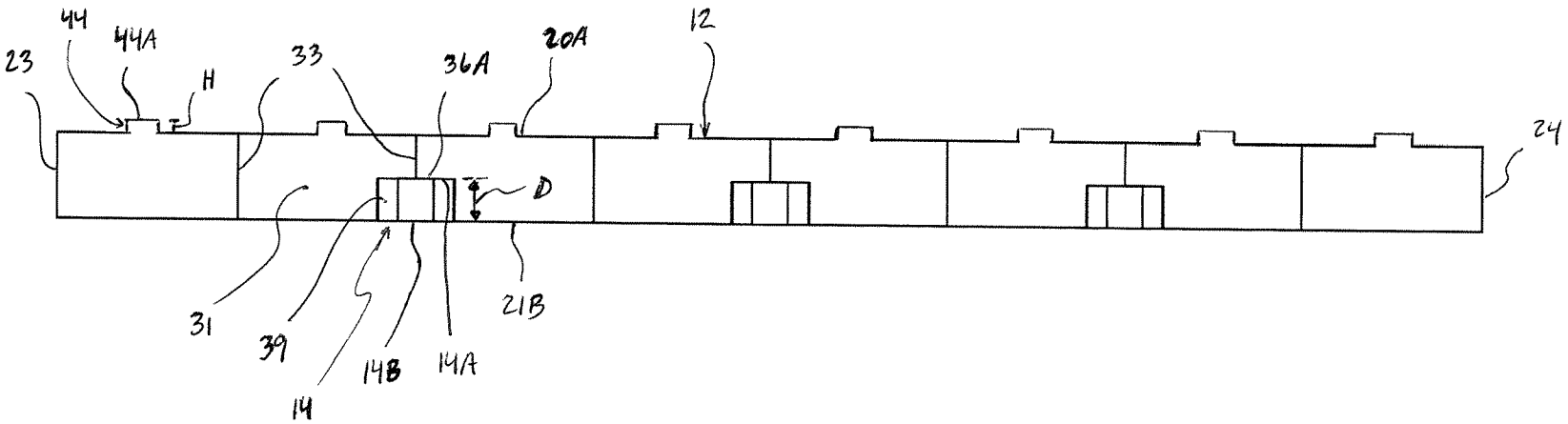
FIG. 2 is an elevational end view of the arrangement of access mat of FIG. 1.

The accompanying figures schematically illustrate an access mat 10 comprising a single unitary body 12 which is formed by pultrusion from composite material comprising longitudinally continuous fibers and a set resin. Also, there is provided a plurality of distinct elongate connector members 14 which are arranged for connection of an end 17 of the single unitary body 12 of a first mat to an adjacent end of another single unitary body (not shown), which in FIG. 1 would be opposite end 18 of the unitary body 12, by bridging from the single unitary body 12 to the adjacent single unitary body, so as to form a series of interconnected ones of the access mat 10 comprising a plurality of interconnected single unitary bodies 12.

The single unitary body 12 of the mat 10 has a planar upper wall 20, a generally planar bottom wall 21 which is parallel to the upper wall 20 and spaced therefrom in a thickness direction of the mat, and two planar parallel side walls 23, 24 which are spaced apart in a width direction of the mat and oriented in the thickness direction to join side edges 25, 26 of the upper wall 20 and those at 27, 28 of the bottom wall 21. The upper wall 20 thus forms an upper horizontal surface 20A arranged to receive materials to be supported by the access mat, and a majority planar portion of the bottom wall 21 forms a horizontal lower surface 21B arranged to rest on the ground.

As the single unitary body 12 including the upper wall 20, bottom wall 21 and side walls 23, 24 is formed by pultrusion, the body 12 including the upper wall 20, the bottom wall 21 and the side walls 23, 24 defines an elongated substantially rectangular tubular body of constant cross section enclosing a hollow interior 31 of the single unitary body 12. The single unitary body 12 is free of filler material such that the hollow interior 31 thereof is empty of filler material.

The single unitary body 12 is sized about 12 to 16 feet, and preferably about 14 feet, in the length direction from one of the ends 17, 18 to the other, and about 6 to 10 feet, and preferably about 8 feet, in the width direction from one of the side walls 23, 24 to the other. Also, the thickness of the single unitary body 12 lies in a range between 4 inches and 8 inches, and is preferably about 6 inches. Thus, the single unitary body 12 is substantially wider and longer than it is thick, typically in the order of at least 9 times wider or longer than the thickness of the mat and may be up to 48 times wider or longer than the thickness of the mat. Preferably, the mat body 12 is about 16 times wider than it is thick, and about 28 times longer than it is thick. Also, the mat body 12 is typically larger in the length direction than it is in the width direction, and typically is about 1.2 to 2.7 times longer than it is wide.

To strengthen the hollow tubular body formed by the mat body 12 via the pultrusion process, the single unitary body 12 includes a plurality of parallel reinforcing ribs 33 extending along a full length of the single unitary body 12 from one end 17, 18 to the other and bridging the hollow interior 31 in a direction across the thickness of the single unitary body 12 so as to resist compression thereof in the thickness direction. As such, the ribs 33 are planar in shape and are oriented perpendicularly transversely to each of the upper wall 20 and the bottom wall 21. The ribs 33 are integrally formed with the single unitary body 12 by pultrusion from the composite material of the mat body 12 comprising longitudinally continuous fibers and a set resin. The ribs 33 are arranged longitudinally of the mat at uniformly spaced positions across the width of the mat body 12.

In order to facilitate interconnection of one mat body 12 and the next to form the series of interconnected mats 10, the bottom wall 21 includes a plurality of recessed channels 36 therein, where the recessed channels 36 have a depth D from the bottom surface 21B of the bottom wall, in a common direction to the thickness of the mat body 12, which is greater than the thickness of the bottom wall 21. Typically, the depth of the channels 36 lies in a range between 1" and 2.25", and preferably is about 2".

The recessed channels 36 are arranged longitudinally of the single unitary body 12, so as to extend in the longitudinal direction of the mat body 12, and at uniformly spaced positions across the width of the single unitary body 12 parallel to one another. The channels 36 also are spaced from the side walls 23, 24 by a common distance as the spacing between an adjacent pair of the channels 36. Thus the channels 36 are uniformly spaced across the width of the bottom wall 21. It will be appreciated that the channels 36 may coincide with location of the reinforcing ribs 33 such that where this occurs, the reinforcing ribs 33 span a shorter distance in the thickness direction of the mat than the full thickness thereof between the upper wall 20 and the bottom wall 21. In the illustrated arrangement, these ribs 33 are shorter in height than the other full-height ribs spanning the full thickness of the mat body 12 by the depth D of the channels 36.

Each connector member 14 is shaped to fit into a respective one of the recessed channels 36 with a bottom surface 14B of the connector member being coplanar with the bottom surface 21B of the mat body 12, and a top surface 14A of the connector member 14 being disposed in engagement with a raised surface 36A of the respective recessed channel 36. Also, opposite side surfaces 14C, 14D of the respective connector member are disposed in engagement with opposite upstanding side surface 36C, 36D of the respective recessed channel 36.

Each recessed channel 36 which is integrally formed in the bottom wall 21 by the pultrusion process has a rectangular cross-sectional shape spanning the full length of the mat body 12 and includes the pair of upstanding side surfaces 36C, 36D interconnecting the bottom surface 21B and the raised channel surface 36A. As such, the bottom wall 21 is generally planar in shape except for at the recessed channels 36 where the bottom wall 21 is stepped to form a rectangular shaped recessed portion which is relatively narrow with respect to the full width of the mat body.

Similarly to the mat body 12, the connector members 14 are formed by pultrusion from composite material comprising longitudinally continuous fibers and a set resin so as to define an elongated rectangular tubular body of constant cross section enclosing a hollow interior 39 of the respective connector member. The respective connector member 14 is free of filler material such that the hollow interior 39 thereof is empty of filler material. Each connector member 14 includes a plurality of parallel reinforcing ribs 41 each spaced from the next in the direction of the width of the member 14. The connector ribs 41 are arranged longitudinally of the member 14 so as to extend in the length direction of the member 14 and are generally planar in shape and oriented perpendicularly transversely to the opposite walls which the ribs 41 interconnect. In the illustrated arrangement, the thickness of the respective connector member 14 lies in a range between 1" and 2.25", and is preferably about 2", and the width of the respective member 14 lies in a range between 6" and 10", and is preferably about 8". That is, in the illustrated arrangement the respective connector member 14 is correspondingly sized in width and thickness to nest in the respective recessed channel 36. As such, the connector members 14 may be connected to the respective one of the adjacent pair of mat bodies by interconnecting fasteners (not shown) or via a snug friction fit due to the complementary sizing and shaping of the channels 36 and the connector members 14.

The access mat 10 further includes on its upper wall 20 a plurality of alternating raised and lowered, or recessed, portions of the upper surface 20A which act to provide traction for vehicles or users traversing the upper wall 20 of the mat body 12. Protrusions 44 of the upper wall upper surface 20A, that is the raised surface portions on the upper wall 20, are arranged longitudinally of the mat body 12 at spaced positions across the width of the single unitary body 12. In the illustrated arrangement, the protrusions 44 span the full length of the mat between the opposite ends 17, 18. The protrusions 44 are parallel to one another and have a top surface 44A which is spaced above the upper surface 20A of the upper wall 20.

The protrusions 44 may be formed by the pultrusion process whereby the single unitary body 12 with the recessed channels 36 is formed. That is, the pultrusion die is arranged to yield a cross-sectional shape of the mat body 12 which includes alternating protrusions and recesses. As such, using this method to form the protrusions 44, they have a height H from the upper wall upper surface 20A which is greater than a thickness of the upper wall 20.

Alternatively, the protrusions 44 may be formed after pultrusion via an impression. That is, after the composite material is pulled through the die, but while the composite material has not wholly cured so as to still be pliable, an impression is pressed into the upper surface 20A of the upper wall 20. In this case, the height H of the protrusions 44 is less than a thickness of the upper wall 20. Also, in this case, the recesses formed between each adjacent pair of the protrusions 44 on the upper wall may have a length which is smaller than the full length of the mat body 12.

In the further alternative, a separate layer which includes the protrusions 44 is connected to the upper wall 20 of the mat body 12 after pultrusion.

The scope of the claims should not be limited by the preferred embodiments set forth in the examples but should be given the broadest interpretation consistent with the specification as a whole.

The invention claimed is:

1. An access mat comprising:

a single unitary body having a generally planar upper wall, a bottom wall and two side walls joining side edges of the upper wall and the bottom wall;

the upper wall forming an upper horizontal surface arranged to receive materials to be supported and the bottom wall arranged to rest on the ground;

the single unitary body including the upper wall, bottom wall and side walls being formed by pultrusion from composite material comprising longitudinally continuous fibers and a set resin so as to define an elongated tubular body of constant cross section enclosing a hollow interior of the single unitary body;

the single unitary body being free of filler material such that the hollow interior thereof is empty of filler material;

the single unitary body including a plurality of parallel reinforcing ribs extending along a length of the single unitary body and bridging the hollow interior in a direction across the thickness of the single unitary body so as to resist compression of the single unitary body in the direction of the thickness of the single unitary body, said ribs being integrally formed with the single unitary body by pultrusion from composite material comprising longitudinally continuous fibers and a set resin;

the bottom wall having a plurality of recessed channels therein where the recessed channels have a depth from the bottom surface greater than the thickness of the bottom wall, the recessed channels being arranged longitudinally of the single unitary body at spaced positions across the width of the single unitary body spaced from the side walls;

and a plurality of elongate connector members each shaped to fit into a respective one of the recessed channels with a bottom surface of the connector member coplanar with the bottom surface and a top surface of the connector member in engagement with a raised surface of the respective recessed channel;

the elongate connector members being arranged for connection of an end of the single unitary body to an adjacent end of another single unitary body by bridging from said single unitary body to the adjacent single unitary body;

the elongate connector members being formed by pultrusion from composite material comprising longitudinally continuous fibers and a set resin so as to define an elongated tubular body of constant cross section enclosing a hollow interior of the respective connector member.

2. The access mat of claim 1 wherein each connector member includes a plurality of reinforcing ribs each spaced from the next in the direction of the width of the member.

3. The access mat of claim 1 wherein the thickness of the respective connector member lies in a range between 1" and 2.25" and the width of the respective member lies in a range between 6" and 10".

* * * * *